United States Patent [19]

Pringle

[11] Patent Number: 4,862,958

[45] Date of Patent: Sep. 5, 1989

[54] COIL TUBING FLUID POWER ACTUATING TOOL

[75] Inventor: Ronald E. Pringle, Houston, Tex.

[73] Assignee: Camco, Incorporated, Houston, Tex.

[21] Appl. No.: 268,129

[22] Filed: Nov. 7, 1988

[51] Int. Cl.[4] ..... E21B 19/22

[52] U.S. Cl. ..... 166/72; 166/212; 166/385

[58] Field of Search ..... 166/374, 375, 383, 385, 166/72, 77, 178, 212, 320, 321, 324, 325

[56] References Cited

U.S. PATENT DOCUMENTS 4,685,516 8/1987 Smith et al. ..... 166/385 X

*Primary Examiner*—William P. Neuder

*Attorney, Agent, or Firm*—Fulbright & Jaworski

[57] ABSTRACT

A power actuating tool for connection to a coil tubing having first and second conduits for supplying first and second fluids, respectively, to the power tool. A housing includes first and second lines for connection to the coil tubing. A fluid actuated holding mechanism is connected to the housing and to the first line for receiving the first fluid for holding the housing in the wall. A fluid power actuator is connected to the housing and in fluid communication with the second line for providing fluid power for actuating the fluid power actuator. A control mechanism is connected to the first line and controls the supply of the second fluid to the fluid power actuator.

10 Claims, 6 Drawing Sheets

COIL TUBING FLUID POWER ACTUATING TOOL

BACKGROUND OF THE INVENTION

Coil tubing services can be used instead of expensive workover rigs for efficiently and economically performing a wide variety of production, completion and workover problems in producing oil and/or gas wells or injection wells. Coil tubing services reduce well downtime and reduce costs by performing many types of operations, and can perform the operations without killing the well. Coil tubing operations are performed by inserting a flexible tubing, which is normally coiled on a reel, into a well conduit and fluids are inserted into the coil tubing under pressure to perform various mechanical and chemical functions.

The present invention is directed to a fluid power actuating tool which can be connected to a coil tubing for performing various functions in a well such as jarring, setting a well tool, or providing power for other functions. The present invention is directed to a fluid power actuating tool which can be connected to a coil tubing and be moved down the well bore, engage the inside of the well conduit, and provide the desired actuating power, all in the presence of the hydrostatic head of the fluids that exist in the coil tubing.

In addition, the present invention provides a fluid power actuating tool which is controlled from the well surface for selectively controlling the speed and amount of the power output.

SUMMARY

The present invention is directed to a power actuating tool for connection to a coil tubing having first and second conduits for supplying first and second fluids, respectively, to the power actuating tool for use in a well. A housing is provided having first and second lines for connection to the coil tubing and to the first and second conduits, respectively. Fluid actuated holding means are connected to the housing and connected to the first line for receiving the first fluid for holding the housing in the well. Fluid power actuating means are connected to the housing and in fluid communication with the second line for providing fluid power for actuating the fluid power means. Control means are connected to the first line and the control means control the supply of the second fluid in the second line to the fluid power actuating means.

Still a further object of the present invention is wherein the fluid actuated holding means includes piston actuated gripping means, a first spring biased valve connected between the first line and the gripping means in which the first valve is biased to a closed position to overcome hydrostatic pressure in the first line but openable by pressurized first fluid. A second spring biased valve is connected to the gripping means for venting pressure from the gripping means. The second valve is biased to an open position to overcome hydrostatic pressure, but is closable by pressurized first fluid.

Still a further object of the present invention is wherein the fluid actuating holding means includes a piston actuated holding means in fluid communication with the first line for actuating the holding means in response to fluid pressure in the first line. Spring means are provided biasing the piston sufficiently to overcome hydrostatic pressure in the first line to prevent actuation of the holding means until the tool is positioned at the desired location in the well.

Still a further object of the present invention is wherein and fluid power actuating means includes piston actuated impact means and fluid impact producing means positioned adjacent to and upstream of the power actuated impact means. In one embodiment, the impact means includes a check valve.

Yet a further object of the present invention is the inclusion of means for venting the fluid pressure in communication with the second line for resetting the power tool.

Still a further object of the present invention is wherein the fluid power actuating means includes piston actuated power means having a spring return and a restricted vent means in fluid communication with the piston actuated power means.

A further object of the present invention is the provision of a power actuating tool, for connection to a coil tubing having first and second conduits for supplying first and second fluids, respectively, for use in a well. A housing has first and second lines for connection to the first and second conduits, respectively, and fluid actuated holding means are connected in the housing. An operating valve in the housing is connected to the first line and controlled by the first fluid and the operating valve includes an openable and closable first port in fluid communication with the second line. A pilot operated valve having a pilot is in fluid communication with the first port and is actuated by the second fluid when the first port is opened. The pilot valve includes an openable and closable second port in fluid communication with the second line. Piston operated power actuated means is in fluid communication with the second side of the second port for being actuated by the second fluid when the second port is opened.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

Figure 1:
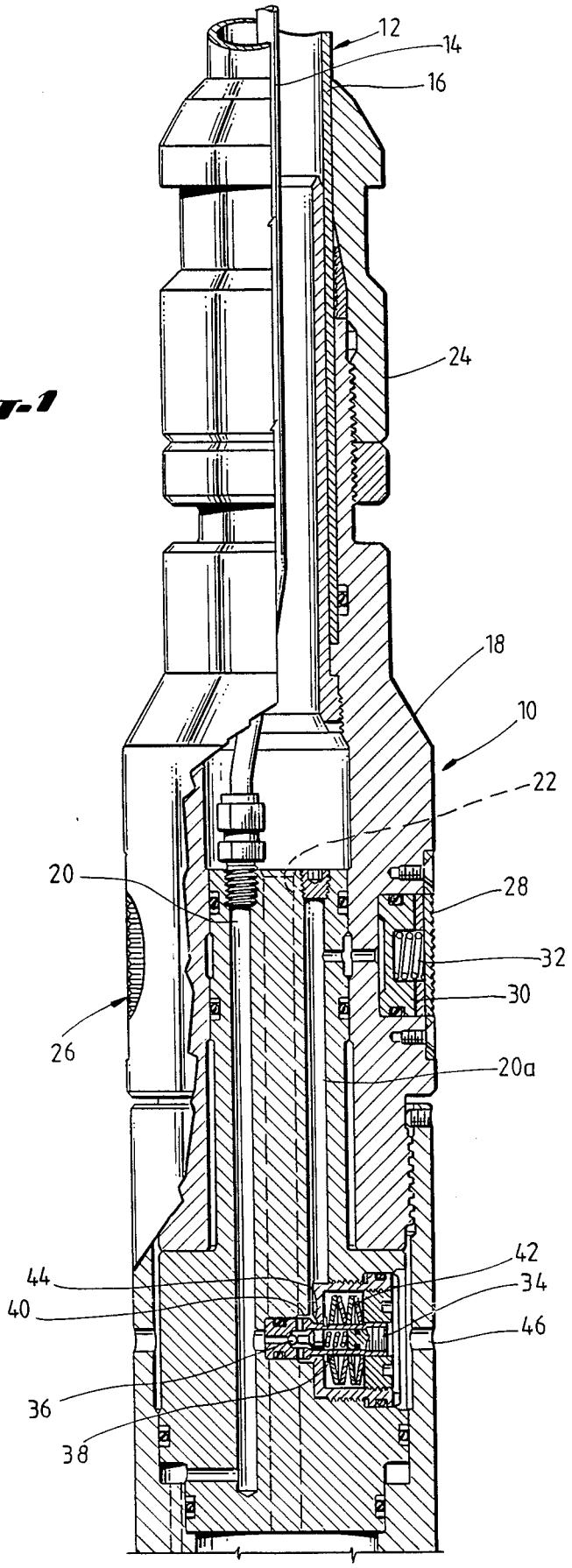
FIGS. 1, 2 and 3 are continuations of each other and constitute an elevational view, partly in cross section, of one embodiment of the present invention.
Figure 2:
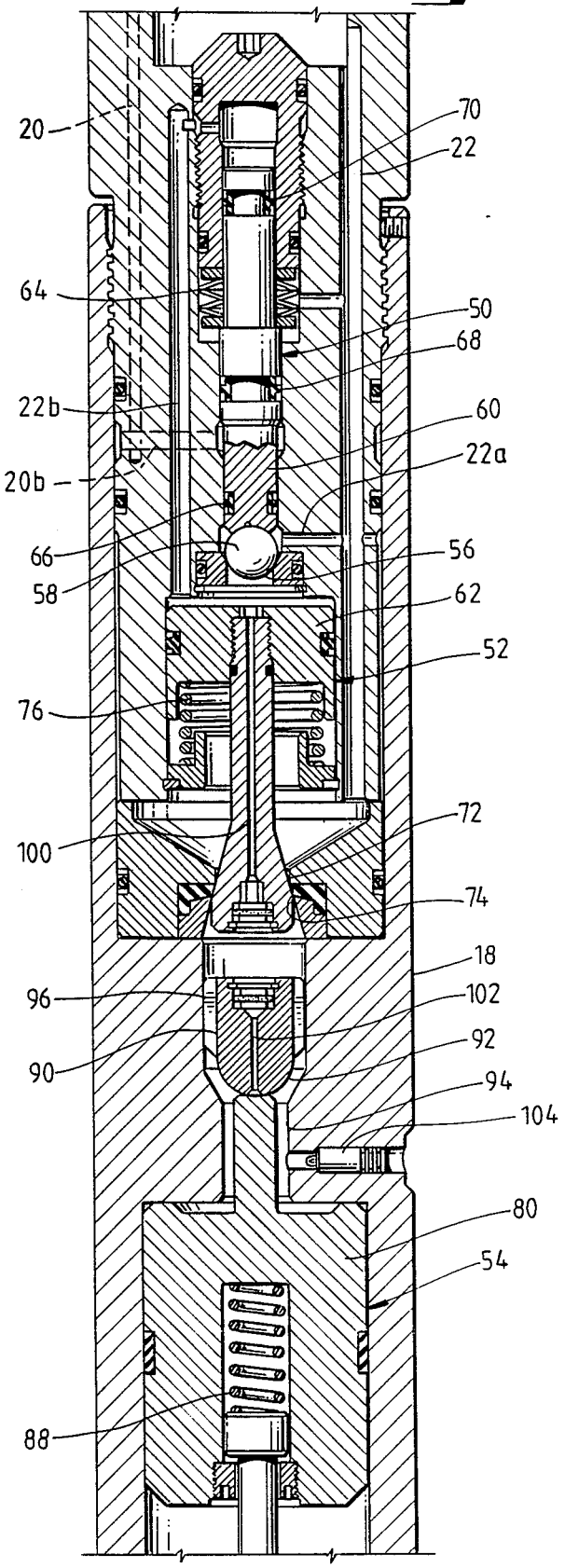
Figure 3:
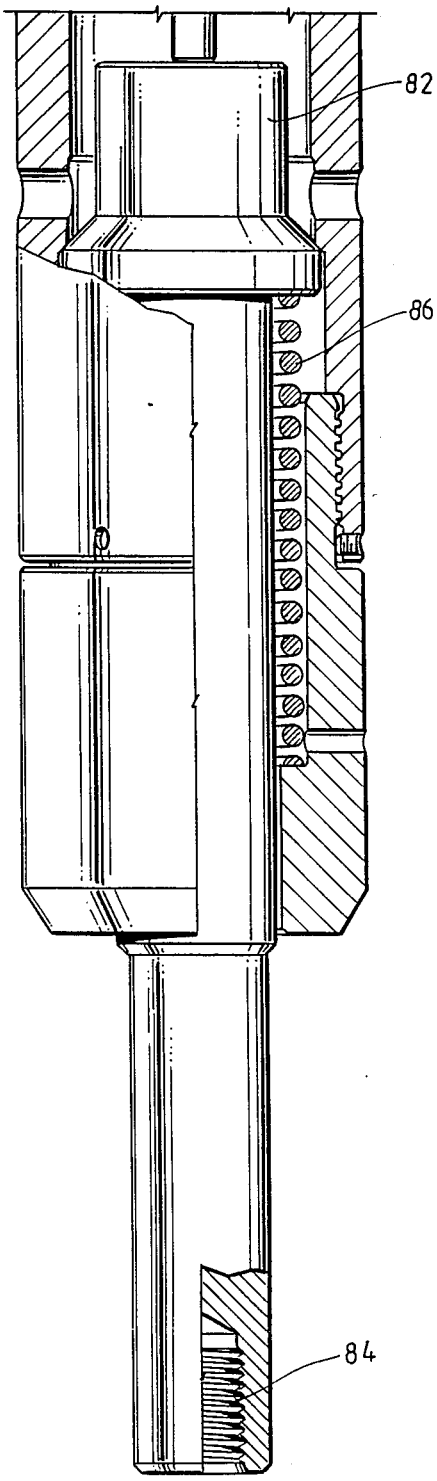

Referring now to the drawings and particularly to FIGS. 1, 2 and 3, the reference numeral 10 generally indicates the power actuating tool of the present invention for use in a well and for connection to a conventional coil tubing 12. The coil tubing 12 includes a first conduit 14 for conducting a first fluid and a second conduit 16 for conducting a second fluid.

A power actuating tool 10 includes a housing 18 having a first line 20 and a second line 22. The housing 18 is adapted to be connected to the coil tubing 12 by a suitable connector 24 and the first line 20 is placed in fluid communication with the first conduit 14 of the coil tubing 12 for receiving the first fluid and the second line 22 is adapted to be connected to the second conduit 16 of the coil tubing 12 for receiving the second fluid. By way of example only, preferably the first fluid supplied through the conduit 14 and line 20 is hydraulic fluid and the second fluid supplied through the conduit 16 and in the line 22 is nitrogen gas although various other types of gases and liquids may be used in either line.

Referring now to FIG. 1, the reference numeral 26 generally indicates fluid actuated holding means connected to the housing 18 for holding the tool 10 in a desired vertical position in a well such as in a well conduit (not shown). The holding means 26 may include one or more gripping means 28, such as slips, which may be actuated by a piston 30 which in turn is in fluid communication with a line 20*a* which is a part of the first line 20 connected to hydraulic fluid. When hydraulic pressure is applied to the line 20 and the line 20*a*, the piston 30 moves outwardly pushing the slips 28 in engagement with a well conduit. A spring 32 is provided to assist in retracting each piston 30 and relieving the pressure on the slips 28 when the hydraulic pressure in the line 20 is vented.

However, it is desirable that the slips 28 be retracted when moving the well tool 10 downwardly or upwardly through a well conduit in a well so that the slips 28 do not drag or grip the well conduit. However, the springs 32 may not be sufficiently strong to retract the pistons 30 and overcome the hydrostatic head of the hydraulic fluid in the line 20 and conduit 14. Therefore, first and second valve means are provided in which the first valve means overcomes the hydrostatic head in the line 20 and prevents it from being applied to line 20*a* until a predetermined pressure is applied, and a second valve means is provided for venting fluid pressure from the line 20*a* when hydraulic pressure in the conduit 14 is vented. Thus, a first valve generally indicated by the reference numeral 34 is provided having a ball valve element 36 spring biased by a spring 38 positioned between the line 20 and 20*a*. The spring 38 is sufficient to actuate the small ball 36 to overcome hydrostatic head in the line 20 but allows passage of hydraulic fluid to line 20*a* to actuate the pistons 30 when pressure is applied to the line 20. A second valve includes a valve element 40 biased by a spring 42 away from a seat 44 for normally venting the fluid pressure in line 20*a* through a port 46 to the outside of the housing 18. Again, the spring 42 is sufficiently strong to bias the valve element 40 away from the seat 44 and overcome hydrostatic pressure in the line 20. However, when a predetermined pressure is applied in the line 20, the valve element 40 is moved to its seating position closing off the vent as well as opening the valve element 36.

Referring now to FIG. 2, the reference numeral 50 generally indicates a control valve 50 for controlling the operation of a pilot operated valve generally indicated by the reference numeral 52 and fluid power actuating means such as a piston operated power actuating means generally indicated by the reference numeral 54. The control valve 50 is controlled by the application of hydraulic pressure in the line 20 and in turn controls the supply of the nitrogen gas in the line 22 through the pilot valve 52 for actuating the power actuating means 54.

The control valve 50 includes a port 56 which is openable and closable by a valve element 58 controlled by a piston 60. The valve element 58 controls the application of gas from the line 22 through a line 22*a* to the pilot piston 62. The piston 60 is biased to a closed position by a spring 64. The hydraulic line 20 supplies fluid to line 20*b* to the piston 60 between a first piston seal 66 and a second larger piston seal 68. Application of hydraulic fluid through the line 20*b* raises the valve element 58 and opens the port 56 allowing the second fluid, nitrogen gas, to pass through the port 56 and act against the pilot piston 62. Line 22*b* applies gas from the port 56 when the valve 50 is opened to a third piston seal 70 which is of the same size as piston seal 66 to provide a gas balance on the piston 60 for allowing the piston 60 to move to the closed position when hydraulic fluid is vented from the line 20.

The pilot valve 52 includes a valve element 72 connected to the pilot piston 62 for controlling the flow of gas from the line 22 through a port 74. The piston 62 is biased by a spring 76 to urge the valve element 72 to close the port 74. When the control piston 50 is actuated, gas from the line 22 flows through the port 56 actuating the pilot piston 52, moving the valve element 72 downwardly off of the port 74 and supplying gas through the port 74 to the piston operated power actuating means 54.

Referring to FIGS. 2 and 3, the piston operated actuated means 54 includes a piston 80 movable in the housing 18 for actuating a hammerhead 82 having a connection such as threads 84 for connection to a suitable tool. Spring 86 is provided for retracting the hammerhead 82 and spring 88 is provided for retracting the piston 80. While the power operated actuating means is shown as a mechanism for providing a downward jar, the nitrogen gas actuating the piston 80 can be directed to the bottom side of the piston 80 for providing an upward jar if desired. In addition, other types of fluid power actuation may be utilized such a providing a mechanism for converting the power of the nitrogen gas into rotary motion.

However, it is desirable to control from the well surface the number and amount of impacts supplied to the piston 80. Therefore, a check valve 90 is provided having a body 92 for moving into and blocking a restriction 94. The body 92 includes fins 96 for centering the body. When the pilot valve 52 is opened and gas flows through the port 74, the gas moves around the body 92 to actuate the piston 80. However, as the piston 80 moves downwardly, the check valve 90 will move into the restriction 94 for limiting the amount of gas supplied to the piston 80.

After the actuation of the piston 80, hydraulic fluid is bled from the line 20 and the control piston 50 is moved to the closed position shutting of gas flow to the top of the pilot piston 62. A bleed line 100 through the pilot piston 62 allows the pressure to equalize on either side of the piston 62 and the spring 76 moves the pilot piston to the closed position closing the second port 74 by the valve element 72. A bleed line 102 in the check valve 90 and a spring-loaded check valve 104 bleeds the gas pressure from the top of the piston 80 allowing the piston 80 to move to its original position.

Therefore, the power actuating tool 10 of the present invention may be controlled easily from the surface by the application and venting of hydraulic fluid from the first conduit 14 to the line 20 for controlling the application of the gas from the conduit 16 to the line 22.

Figure 4:
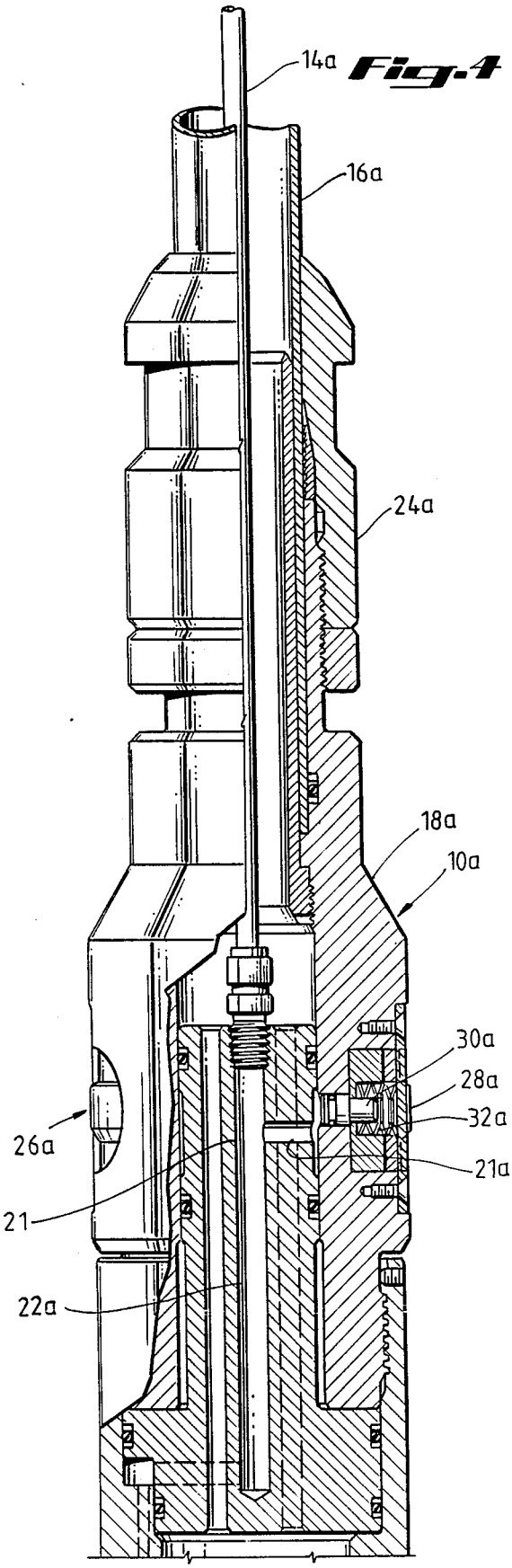
FIGS. 4, 5 and 6 are continuations of each other and constitute an elevational view, partly in cross section, of another embodiment of the present invention.
Figure 6:
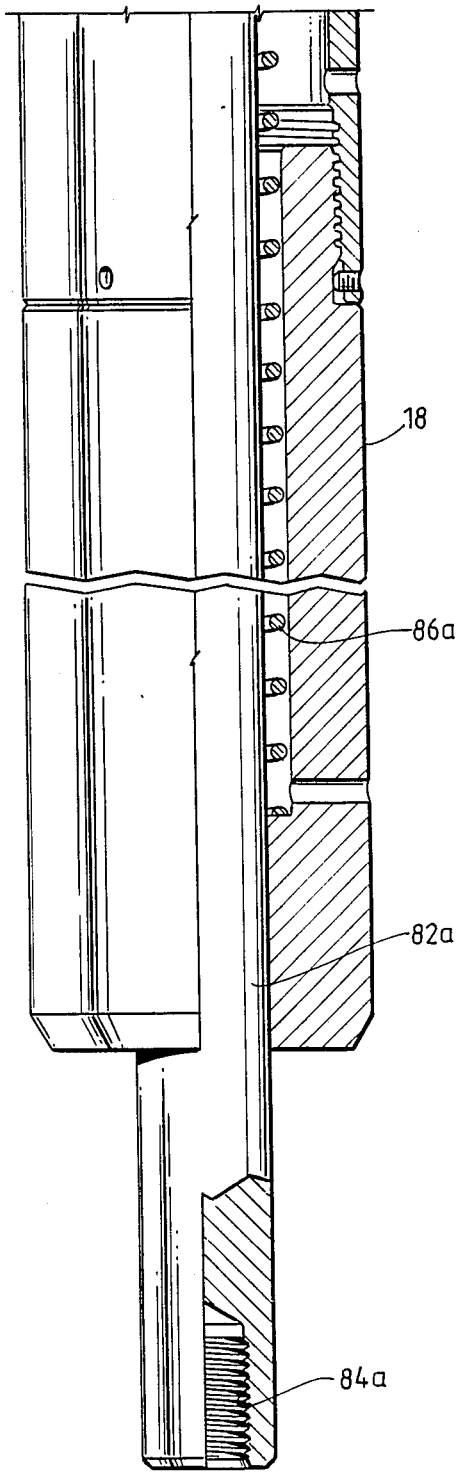
Figure 5:
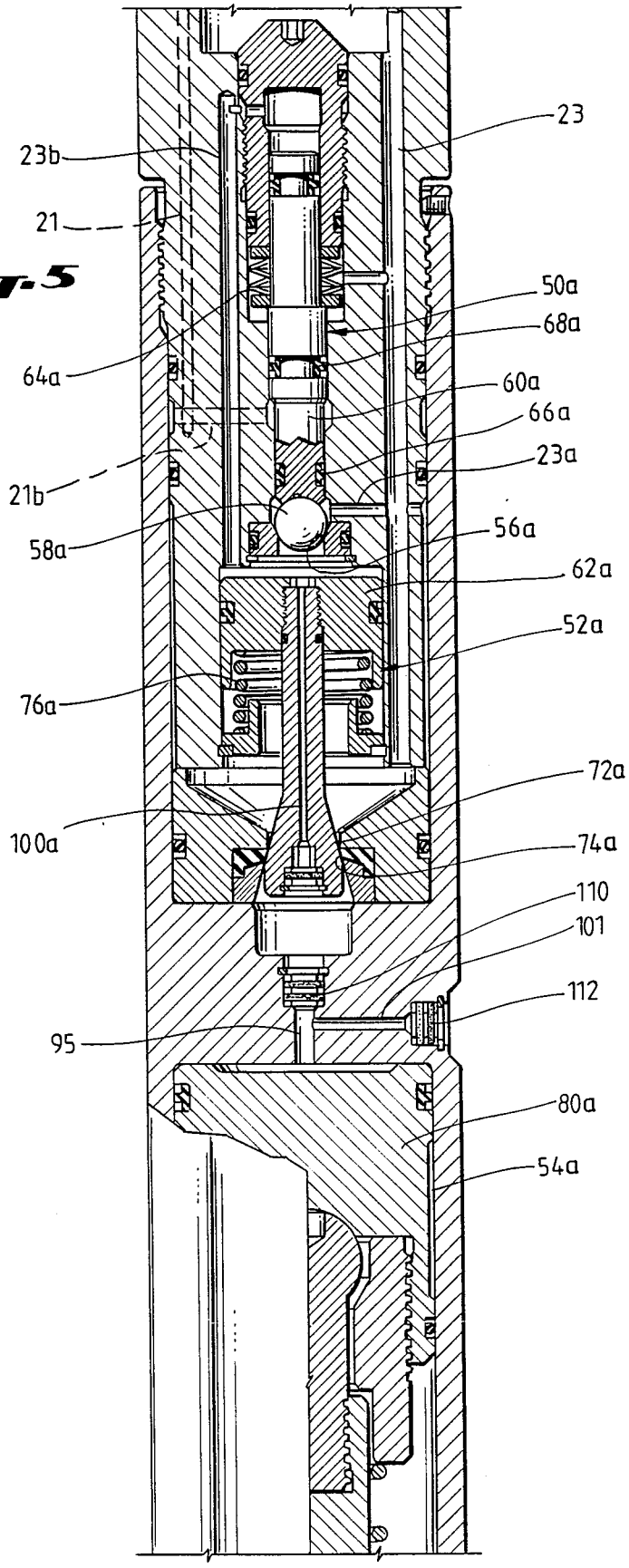

Other and further embodiments of the power actuating tool of the present invention may be provided. Referring now to FIGS. 4–6, another embodiment of the present invention is shown in which like parts to those in FIGS. 1–3 are similarly numbered with the addition of the suffix "a". The power actuating tool 10a of FIGS. 4–6 is designed to provide a constant pressure stroke device for providing a longitudinal power stroke for various uses such as setting a well packer in a well conduit.

Referring now to FIG. 4, the fluid actuating means 26a may include one or more dogs 28a for being set in a nipple in a well conduit (not shown). The dogs 28a are moved outwardly into a set position by the application of a first fluid, such as hydraulic fluid, through the conduit 14a to the lines 21 and 21a to energize a piston 30a. Springs 32a are provided for retracting the pistons 30a for releasing the locking dogs 28a. In this embodiment, the strength of the springs 32a as compared to the size of the pistons 30a is sufficient to overcome the hydrostatic head in the line 21.

The control valve 50a shown in FIG. 5 may be the same as that shown as valve 50 in FIG. 2. That is, hydraulic fluid is applied to line 21 to the piston 60a between the seals 66a and 68a to open the port 56.

Similarly, pilot valve 52a operates similar to the valve 52 of FIG. 2. That is, when the control valve 50a is open, fluid, such as nitrogen gas, flows through the line 23 and the open port 56a to actuate the pilot piston 62a and open the second port 74a. Gas then flows through the port 74a to the fluid actuating means 54a moving it downwardly. In this embodiment, the fluid power actuating means 54a is connected to a tool holder 82a which includes threads 84a for supporting a working tool. In this embodiment, a constant pressure stroke is applied to the piston 80a through a line 95. A vent line 101 is provided for relieving and venting the pressure after actuation of the piston 80a. The admission of the gas from the pilot 52a to the actuating piston 80a is controlled by filters 110 and 112 which may be suitable mesh filters. However, the filter 112 is of a tighter mesh than the filter 110 thereby serving as a restriction for insuring that the admission of gas into the line 95 is used to actuate the piston 80a, but allows the pressure on the piston 80a to be vented at the conclusion of the power stroke.

In this embodiment, the well tool 10a of the present invention is actuated by the application of hydraulic pressure in the line 14a for actuating the fluid holding means 26a, the control valve 50a to in turn actuate the pilot valve 52a to provide a pressure stroke to the power piston 80a. Venting the hydraulic fluid from the line 14a allows the control valve 50a to close, closing the pilot valve 52a, venting the pressure off of the piston 80a and retracting the power actuating means 54a.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will readily suggest themselves to those skilled in the art and which are encompassed within the spirit of the invention and the scope of appended claims.

What is claimed is:

1. A power actuating tool, for connection to a coil tubing having first and second conduits for supplying first and second fluids, respectively, for use in a well, comprising, a housing having first and second lines for connection to said coil tubing and to said first and second conduits, respectively, fluid actuated holding means connected to the housing, said holding means said holding means connected to the first line for receiving said first fluid for holding the housing in the well, fluid power actuating means connected to the housing and in fluid communication with the second line for providing fluid power for actuating said fluid power means, and control means connected to the first line, said control means controlling the supply of said second fluid in said second line to the fluid power actuating means.

2. The apparatus of claim 1 wherein the fluid actuated holding means includes, piston actuated gripping means, a first spring biased valve connected between the first line and the gripping means, said first valve biased to a closed position to overcome hydrostatic pressure in the first line but openable by pressurized first fluid, a second spring biased valve connected to the gripping means for venting pressure from the gripping means, said second valve biased to an open position to overcome hydrostatic pressure, but closable by pressurized first fluid.

3. The apparatus of claim 1 wherein the fluid actuated holding means includes, piston actuated holding means in fluid communication with the first line for actuating the holding means in response to fluid pressure, spring means biasing the piston sufficiently to overcome hyrostatic pressure in the first line.

4. The apparatus of claim 1 wherein the fluid power actuating means includes, piston actuated impact means, and fluid impact producing means positioned adjacent to and upstream of the power actuated impact means.

5. The apparatus of claim 1 wherein the piston actuated impact means includes a check valve.

6. The apparatus of claim 1 including means for venting the fluid pressure in communication with the second line.

7. The apparatus of claim 1 wherein the fluid power actuating means includes, piston actuated power means having a spring return, and restricted vent means in fluid communication with the piston actuated power means.

8. A power actuating tool, for connection to a coil tubing having first and second conduits for supplying first and second fluids, respectively, for use in a well comprising, a housing having first and second lines for connection to said coil tubing and to said first and second conduits, respectively, fluid actuated holding means connected to the housing, said holding means being in fluid communication with the first line for receiving said first fluid for holding the housing in the well, a control valve in the housing connected to the first line and controlled by the first fluid, said control valve including an openable and closable first port in fluid communication with the second line, a pilot operated valve having a pilot in fluid communication with the first port and actuated by the second fluid when the first port is opened, said pilot valve including an openable and closable second port in fluid communication with the second line, and piston operated power actuating means in fluid communication with the second side of the second port for being actuated by the second fluid when the second port is opened.

9. The apparatus of claim 8 including, check valve means positioned in the second line between the second port and the piston operated power actuating means for providing a quick fluid impact to the piston operated power actuating means.

10. The apparatus of claim 8 including a restricted vent means in fluid communication with the second side of the second port.

* * * * *

UNITED STATES PATENT OFFICE

CERTIFICATE OF CORRECTION

Patent No. 4,862,958 Dated September 5, 1989

Inventor(s) Ronald E. Pringle

It is certified that error appears in the above-identified patent and that said Letters Patent is hereby corrected as shown below:

Column 5, line 66, delete the second occurrence of "said holding means"

Signed and Sealed this

Twenty-fifth Day of September, 1990

*Attest:*

HARRY F. MANBECK, JR.

*Attesting Officer*

*Commissioner of Patents and Trademarks*